US012781300B2

(12) United States Patent
Song et al.

(10) Patent No.: US 12,781,300 B2
(45) Date of Patent: Nov. 3, 2026

(54) AUSTENITIC STAINLESS STEEL HAVING IMPROVED STRENGTH, AND METHOD FOR MANUFACTURING SAME

(71) Applicant: POSCO, Pohang-si (KR)

(72) Inventors: Seok Weon Song, Pohang-si (KR); Hak Kim, Pohang-si (KR); Ji Soo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 864 days.

(21) Appl. No.: 17/622,474

(22) PCT Filed: Jun. 10, 2020

(86) PCT No.: PCT/KR2020/007524
§ 371 (c)(1),
(2) Date: Dec. 23, 2021

(87) PCT Pub. No.: WO2021/010599
PCT Pub. Date: Jan. 21, 2021

(65) Prior Publication Data

US 2022/0267875 A1 Aug. 25, 2022

(30) Foreign Application Priority Data

Jul. 17, 2019 (KR) ..... 10-2019-0086348

(51) Int. Cl.

| | |
|---|---|
| ***C21D 9/46*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/42*** | (2006.01) |
| ***C22C 38/58*** | (2006.01) |

(52) U.S. Cl.
CPC ..... *C21D 9/46* (2013.01); *C21D 6/004* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C22C 38/001* (2013.01); *C22C 38/02* (2013.01); *C22C 38/42* (2013.01); *C22C 38/58* (2013.01); *C21D 2211/001* (2013.01)

(58) Field of Classification Search
CPC ..... C21D 9/46; C21D 6/004; C21D 6/005; C21D 6/008; C21D 8/0205; C21D 8/0226; C21D 8/0236; C21D 2211/001; C21D 1/26; C22C 38/001; C22C 38/02; C22C 38/58; C22C 38/34; C22C 38/38
See application file for complete search history.

(56) References Cited

U.S. PATENT DOCUMENTS

| | | | | |
|---|---|---|---|---|
| 3,756,807 | A | 9/1973 | Hoshino et al. | |
| 5,286,310 | A | 2/1994 | Carinci et al. | |
| 2017/0268076 | A1* | 9/2017 | Talonen | C22C 38/02 |

FOREIGN PATENT DOCUMENTS

| | | | | |
|---|---|---|---|---|
| CN | 106574351 | A | 4/2017 | |
| CN | 108291289 | A | 7/2018 | |
| CN | 108531817 | A | 9/2018 | |
| CN | 109112430 | A | 1/2019 | |
| EP | 3878983 | A1 * | 9/2021 | C21D 1/42 |
| JP | S50-5968 | B1 | 3/1975 | |
| JP | H11-92885 | A | 4/1999 | |
| JP | 2008-291282 | A | 12/2008 | |
| JP | 2013-527320 | A | 6/2013 | |
| JP | 2015-206118 | A | 11/2015 | |
| KR | 10-2006-0075725 | A | 7/2006 | |
| KR | 10-2010-0097741 | A | 9/2010 | |
| KR | 10-2016-0080315 | A | 7/2016 | |
| KR | 10-2017-0029631 | A | 3/2017 | |
| KR | 10-2018-0018908 | A | 2/2018 | |
| KR | 10-1844573 | B1 | 4/2018 | |
| WO | 2019/059660 | A1 | 3/2019 | |
| WO | 2019/132226 | A1 | 7/2019 | |

OTHER PUBLICATIONS

Japanese Office Action dated Feb. 21, 2023 issued in Japanese Patent Application No. 2022-502551 (with English translation).
Extended European Search Report dated Jul. 19, 2022 issued in European Patent Application No. 20840538.1.
Chinese Office Action dated May 7, 2022 issued in Chinese Patent Application No. 202080048691.6 (with English translation).
International Search Report dated Dec. 17, 2020 issued in International Patent Application No. PCT/KR2020/007524.
Korean Notice of Allowance dated Apr. 15, 2021 issued in Korean Patent Application No. 10-2019-0086348.
Korean Office Action dated Nov. 23, 2020 issued in Korean Patent Application No. 10-2019-0086348.

* cited by examiner

*Primary Examiner* — Nicholas A Wang
(74) *Attorney, Agent, or Firm* — Morgan Lewis & Bockius LLP

(57) ABSTRACT

Provided is an austenitic stainless steel having improved strength. This austenitic stainless steel includes, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, and satisfies Expressions (1), (2), and (3) below:

$$15 \le 0.2Mn+337C+1.2Cu-1.7Cr+3.3Ni+78N-3.5Si+3.0 \le 30 \quad \text{Expression (1)}$$

$$2.3 \le [Cr+1.5Si]/[Ni+0.31Mn+22C+1Cu+14.2N] \le 3.0 \quad \text{Expression (2)}$$

$$1.0 \le ((Cr+1.5Si+18)/(Ni+0.52Cu+30(C+N)+0.5Mn+36)+0.262)*161-161 \le 7.0 \quad \text{Expression (3)}$$

wherein C, N, Si, Mn, Cr, Ni, and Cu refer to contents of the elements, respectively.

3 Claims, No Drawings

AUSTENITIC STAINLESS STEEL HAVING IMPROVED STRENGTH, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2020/007524, filed on Jun. 10, 2020, which in turn claims the benefit of Korean Application No. 10-2019-0086348, filed on Jul. 17, 2019, the entire disclosures of which applications are incorporated by reference herein.

TECHNICAL FIELD

The present disclosure relates to an austenitic stainless steel, and more particularly, to an austenitic stainless steel having improved strength together with excellent elongation and productivity.

BACKGROUND ART

In accordance with environmental regulations in recent years, there has been demand for light-weight and high strength of steel materials suitable for structural members such as vehicles and railways to increase energy efficiency. Accordingly, production of structural materials has been changed from mass production of limited items in the past into small quantity production of diverse items according to demands of consumers and current trends.

Stainless steels not only provided alternatives with respect to environmental regulation and energy efficiency issues due to strength and formability thereof, but also are suitable for small quantity production of diverse items since investment for additional facilities to improve corrosion resistance is not required. However, there is a problem that stainless steels have lower yield strength and tensile strength compared to general carbon steels for structures. Thus, there is a need to develop a stainless steel having strength similar to that of carbon steels.

In general, stainless steels are classified based on chemical components or metal structures thereof. Depending on the metal structure, stainless steels are classified into austenitic, ferritic, martensitic, and dual phase stainless steels.

Stainless steels have a problem of low productivity because they are formed of relatively expensive elements and have higher alloy contents compared to structural carbon steels for structures. Particularly, in the case of products that require formation, austenitic stainless steels are required rather than relatively inexpensive ferritic stainless steels. However, high prices of Ni and Mo included in austenitic stainless steels cause problems in terms of price competitiveness and limit use of austenitic stainless steels in structural members such as vehicles due to unstable supply and demand of materials and unstable supply prices due to a wide fluctuation in prices of materials.

Therefore, there is a need to develop austenitic stainless steels applicable to structural members such as vehicles by improve strength and formability while reducing the content of expensive elements such as Ni and Mo.

DISCLOSURE

Technical Problem

The present disclosure provides an austenitic stainless steel with improved strength together with elongation and productivity.

Technical Solution

One aspect of the present disclosure provides an austenitic stainless steel with improved strength comprising, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, the austenitic stainless steel satisfying Expressions (1), (2), and (3) below:

$$15 \le 0.2Mn+337C+1.2Cu-1.7Cr+3.3Ni+78N-3.5Si+3.0 \le 30 \quad \text{Expression (1)}$$

$$2.3 \le [Cr+1.5Si]/[Ni+0.31Mn+22C+1Cu+14.2N] \le 3.0 \quad \text{Expression (2)}$$

$$1.0 \le ((Cr+1.5Si+18)/(Ni+0.52Cu+30(C+N)+0.5Mn+36)+0.262)*161-161 \le 7.0 \quad \text{Expression (3)}$$

wherein C, N, Si, Mn, Cr, Ni, and Cu refer to contents of the elements, respectively.

In an embodiment of the present disclosure, an average grain size may be 5 μm or less.

In an embodiment of the present disclosure, a tensile strength may be 1200 MPa or more.

In an embodiment of the present disclosure, a yield strength may be 800 MPa or more.

In an embodiment of the present disclosure, an elongation may be equal to or more than 20% and equal to or less than 30%.

In an embodiment of the present disclosure, an elongation may be equal to or more than 25% and equal to or less than 30%.

One aspect of the present disclosure provides a method of manufacturing an austenitic stainless steel with improved strength, the method including: preparing a slab comprising, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, and satisfying Expressions (1), (2), and (3) below; hot rolling the slab to a steel sheet; hot annealing the hot-rolled steel sheet; cold rolling the hot-rolled, annealed steel sheet; and cold annealing the cold-rolled steel sheet at a temperature of 800 to 1,000° C., $$15 \le 0.2Mn+337C+1.2Cu-1.7Cr+3.3Ni+78N-3.5Si+3.0 \le 30 \quad \text{Expression (1)}$$

$$2.3 \le [Cr+1.5Si]/[Ni+0.31Mn+22C+1Cu+14.2N] \le 3.08 \quad \text{Expression (2)}$$

$$1.0 \le ((Cr+1.5Si+18)/(Ni+0.52Cu+30(C+N)+0.5Mn+36)+0.262)*161-161 \le 7.0 \quad \text{Expression (3)}$$

wherein C, N, Si, Mn, Cr, Ni, and Cu refer to contents of the elements, respectively.

In an embodiment of the present disclosure, a cold rolling reduction ratio may be 50% or more during the hot rolling.

In an embodiment of the present disclosure, the cold annealing may be performed for 10 seconds to 10 minutes.

In an embodiment of the present disclosure, the hot annealing may be performed at a temperature of 800 to 1100° C. for 10 seconds to 10 minutes.

In an embodiment of the present disclosure, a volume fraction of an austenite phase after the hot annealing may be 90% or more.

Advantageous Effects

According to embodiments of the present disclosure, an austenitic stainless steel having improved strength together with elongation and productivity may be provided with a lower cost decreased than that of STS304 by about 50%.

BEST MODE

An austenitic stainless steel with improved strength includes, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, the austenitic stainless steel satisfies Expressions (1), (2), and (3) below:

$$15 \leq 0.2Mn+337C+1.2Cu-1.7Cr+3.3Ni+78N-3.5Si+3.0 \leq 30 \quad \text{Expression (1)}$$

$$2.3 \leq [Cr+1.5Si]/[Ni+0.31Mn+22C+1Cu+14.2N] \leq 3.0 \quad \text{Expression (2)}$$

$$1.0 \leq ((Cr+1.5Si+18)/(Ni+0.52Cu+30(C+N)+0.5Mn+36)+0.262)*161-161 \leq 7.0 \quad \text{Expression (3)}$$

wherein C, N, Si, Mn, Cr, Ni, and Cu refer to contents of the elements, respectively.

Modes of the Invention

Hereinafter, embodiments of the present disclosure will be described in detail. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, unless explicitly described to the contrary, the term "include" will be understood to imply the inclusion of stated elements but not the exclusion of any other elements.

As used herein, the singular forms are intended to include the plural forms as well, unless the context clearly indicates otherwise.

Hereinafter, embodiments of the present disclosure will be described in detail.

An austenitic stainless steel with improved strength according to an embodiment of the present disclosure includes, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and other inevitable impurities.

Hereinafter, reasons for numerical limitations on the contents of alloy components in the embodiment of the present disclosure will be described. Hereinafter, the unit is wt % unless otherwise stated.

The content of C is from 0.06 to 0.15%.

Carbon (C) is an element effective for stabilization of an austenite phase and may be added in an amount of 0.06% or more to obtain yield strength of austenitic stainless steels. However, an excess of C may not only deteriorate cold processibility due to solid solution strengthening effects but also induce grain boundary precipitation of a Cr carbide, thereby adversely affecting ductility, toughness, corrosion resistance. For this reason, an upper limit thereof may be set to 0.15%.

The content of N is 0.3% or less (excluding 0).

Nitrogen (N) is a strong austenite-stabilizing element effective for enhancing corrosion resistance and yield strength of austenitic stainless steels. However, an excess of N may deteriorate cold processibility due to solid solution strengthening effects. Thus, an upper limit thereof may be set to 0.3%.

The content of Si is more than 1.0% and equal to or less than 2.0%.

Silicon (Si), serving as a deoxidizer during a steelmaking process, is effective for enhancing corrosion resistance and may be added in an amount more than 1.0%. However, because Si is also an element effective for stabilizing a ferrite phase, an excess of Si may promote formation of delta (δ) ferrite in a cast slab, thereby not only deteriorating hot processibility but also deteriorating ductility and toughness of a steel material due to solid solution strengthening effects. Thus, an upper limit thereof is set to 2.0%.

The content of Mn is from 5.0 to 7.0%.

Manganese (Mn), as an element for stabilizing an austenite phase added as a Ni substitute, may be added in an amount of 5.0% or more to enhance cold rollability by inhibiting formation of strain-induced martensite. However, an excess of Mn may cause an increase in formation of S-based inclusions (MnS) resulting in deterioration of ductility, toughness, and corrosion resistance of austenitic stainless steels. Thus, an upper limit thereof is set to 7.0%.

The content of Cr is from 15.0 to 16.0%.

Chromium (Cr) is not only a ferrite-stabilizing element but also effective for suppressing formation of a martensite phase. The content of Cr may be 15% or more as a basic element for obtaining corrosion resistance required for stainless steels. However, an excess of Cr increases manufacturing costs and promote formation of delta (δ)ferrite in a slab resulting in deterioration of hot processibilty. Thus, an upper limit thereof may be set to 16.0%.

The content of Ni is 0.3% or less (excluding 0).

Nickel (Ni), as a strong austenite phase-stabilizing element, is essential to obtain satisfactory hot processibility and cold processibilty. However, because Ni is an expensive element, costs of raw materials may increase in the case of adding a large amount of Ni. Therefore, an upper limit thereof may be set to 0.3% in consideration of both costs and efficiency of steel materials.

The content of Cu is 2.5% or less (excluding 0).

Copper (Cu), as an austenite phase-stabilizing element, enhances corrosion resistance under a reducing environment and is effective for softening of austenitic stainless steels. However, an excess of Cu not only increases costs of raw materials but also deteriorates hot processibilty. Thus, an upper limit thereof may be set to 2.5% in consideration of costs and efficiency of steel materials and hot processibilty thereof.

In addition, the austenitic stainless steel with improved strength according to an embodiment of the present disclosure may further include at least one selected from phosphorus in an amount of 0.035% or less and sulfur in an amount of 0.01% or less.

The content of P is 0.035% or less.

Phosphorus (P), as an impurity that is inevitably contained in steels, is a major causative element of grain boundary corrosion or deterioration of hot processibilty, and therefore, it is preferable to control the P content as low as possible. In the present disclosure, an upper limit of the content of P is controlled to be 0.035%.

The content of S is 0.01% or less.

Sulfur (S), as an impurity that is inevitably contained in steels, is a major causative element of deterioration of hot possibility as being segregated in grain boundaries, and therefore, it is preferable to control the S content as low as possible. In the present disclosure, an upper limit of S is controlled to be 0.01%.

The remaining ingredient of the austenitic stainless steel of the present disclosure is iron (Fe). However, in common manufacturing processes, undesired impurities from raw materials or manufacturing environments may be inevitably mixed therewith, and this cannot be excluded. Such impurities are well-known to those of ordinary skill in the art, and thus, specific descriptions thereof will not be given in the present disclosure.

A material applied to structural members such as vehicles needs to have not only strength but also formability. However, there is a problem that an increase in strength inevitably causes an increase in yield strength and a decrease in elongation. In addition, in order to obtain price competitiveness of austenitic stainless steels, the contents of expensive austenite-stabilizing elements such as Ni need to be reduced and it is required to estimate amounts of Mn and Cu for compensating for the expensive austenite-stabilizing elements.

In the present disclosure, Expression (1) was derived in consideration of strain accommodating mechanism and the degree of recrystallization with respect to deformation of the austenitic stainless steel.

$$0.2Mn+337C+1.2Cu-1.7Cr+3.3Ni+78N-3.5Si+3.0 \quad \text{Expression (1):}$$

In this regard, Mn, C, Cu, Cr, Ni, N, and Si refer to contents of the elements, respectively.

In the austenitic stainless steel with improved strength according to an embodiment of the present disclosure, a value obtained by Expression (1) above satisfies a range of 15 to 30.

It was confirmed that as the value of Expression (1) decreases, partial dislocation occurs in a wider gap by an external stress, such as cold rolling, applied to a steel material, so that phase transformation more easily occurs. Therefore, strain-induced martensite is easily, rapidly formed due to a low reduction ratio thereby. As such, the rapidly formed strain-induced martensite may cause plate breakage of the steel material during cold rolling and also induce fine cracks during the cold rolling. In addition, rapidly formed strain-induced martensite and a wide gap dislocation sliding behavior decrease elongation in a final product, and thus a lower limit of Expression (1) is set to 15.

On the contrary, when the value of Expression (1) is too high, partial dislocation occurs in a narrower gap by an external stress, such as cold rolling, applied to a steel material, so that strain-induced martensite is difficult to be formed. Even when the strain-induced martensite is formed, sufficient recrystallization sites cannot be provided during cold annealing, and thus fine grains cannot be obtained, thereby failing to obtain yield strength.

In addition, when the value obtained by Expression (1) is too high, phase transformation and dislocation accumulation are limited, so that tensile strength of the austenitic stainless steel cannot be maintained after cold annealing, and thus an upper limit thereof is set to 30.

In addition, Expression (2) was derived in consideration of phase balance of the austenitic stainless steel in the present disclosure. In the austenitic stainless steel with improved strength according to an embodiment of the present disclosure, a value obtained by Expression (2) below satisfies a range of 2.3 to 3.0.

$$[Cr+1.5Si]/[Ni+0.31Mn+22C+1Cu+14.2N] \quad \text{Expression (2):}$$

In this regard, Cr, Si, Ni, Mn, C, Cu, and N refer to contents of the elements, respectively.

When the value of Expression (2) is less than 2.3, stability of austenite is relatively enhanced so that fine grains having an average grain diameter of 5 μm or less cannot be obtained. On the contrary, when the value of Expression (2) exceeds 3.0, a ferrite fraction of the austenitic stainless steel before deformation is significantly increased, resulting in a significant decrease in elongation.

In addition, Expression (3) was derived in consideration of the ferrite fraction of the austenitic stainless steel of the present disclosure at a high temperature. In the austenitic stainless steel with improved strength according to an embodiment of the present disclosure, a value represented by Expression (3) below satisfies a range of equal to or more than 1.0 and equal to or less than 7.0.

$$((Cr+1.5Si+18)/(Ni+0.52Cu+30(C+N)+0.5Mn+36)+0.262)*161-161 \quad \text{Expression (3):}$$

In this regard, Cr, Si, Ni, Cu, C, N, and Mn refer to contents of the elements, respectively.

When the value of Expression (3) is less than 1.0, a certain amount of the ferrite fraction cannot be obtained during hot rolling, so that a coarse austenite phase with a large grain size is formed. Therefore, an amount of impurities accumulated in grain boundaries increases causing brittleness, failing to obtain hot processability.

On the contrary, when the value of Expression (3) exceeds 7.0, an excess of delta ferrite is formed during hot rolling, causing cracks between boundaries between the austenite phase and the ferrite phase, so that hot processibilty cannot be obtained. Also, ferrite cannot be completely decomposed during annealing and hot working, and thus properties of materials required for final products cannot be obtained. Therefore, the value of Expression (3) may be controlled within a range of 1.0 to 7.0 in the present disclosure in consideration of cracks occurring during hot rolling.

The austenitic stainless steel according to the present disclosure satisfying the composition range of the alloy elements and the expressions about relations among the components may include 90 vol % or more of the austenite phase as a microstructure and the remainder of delta ferrite and other carbides after hot rolling and annealing processes. By obtaining 90 vol % or more of the austenite phase before cold rolling, grains may be refined together with phase transformation during a subsequent cold rolling process.

In addition, an average grain size of the austenitic stainless steel according to the present disclosure is 5 μm or less.

According to an embodiment of the present disclosure, an austenitic stainless steel satisfying the above-described alloy composition may have a tensile strength of 1200 MPa or more and a yield strength of 800 MPa or more.

In addition, according to an embodiment of the present disclosure, the austenitic stainless steel satisfying the above-described alloy composition may have an elongation of 20% to 30%, preferably, 25% to 30%.

Next, a method of manufacturing an austenitic stainless steel with improved strength according to another embodiment of the present disclosure will be described.

A method of manufacturing an austenitic stainless steel with improved strength according to another embodiment of the present disclosure includes: preparing a slab including, in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, and satisfying Expressions (1), (2), and (3) below; hot rolling the slab to a steel sheet; hot annealing the hot-rolled steel sheet; cold rolling the hot-annealed steel sheet; and cold annealing the cold-rolled steel sheet at a temperature of 800 to 1,000° C.

The reasons for the numerical limitations on the contents of the alloy components are as described above.

The stainless steel having the above-described composition is produced by preparing a slab by continuous casting or steel ingot casting and performing a series of hot rolling and hot annealing processes and then cold rolling and cold annealing processes.

Conventionally, as a method of enhancing strength of austenitic stainless steels, skin pass rolling has been introduced. The skin pass rolling is a method of using high work hardening occurring as the austenite phase is transformed into strain-induced martensite during cold working. However, elongation of the austenitic stainless steel to which the skin pass rolling is applied is rapidly decreased, making it difficult to perform a subsequent process.

In order to enhance both strength and elongation of the austenitic stainless steel, grain refinement needs to be performed. In the present disclosure, as a method for overcoming the disadvantages of the skin pass rolling, grains of the austenitic stainless steel are refined by controlling cold rolling conditions.

For example, the slab may be hot-rolled at a normal rolling temperature of 1,100 to 1,200° C., and a hot-rolled steel sheet may be hot annealed at a temperature of 800 to 1,100° C. In this case, the hot annealing may be performed for 10 seconds to 10 minutes.

Then, the hot-rolled, annealed steel sheet may be cold-rolled to prepare a thin plate. The cold rolling may be performed under the conditions of a reduction ratio of 50% or more.

When the reduction ratio is not sufficient during cold rolling, phase transformation does not completely occur in the above-described alloy composition. Accordingly, recrystallization of the remaining austenite phase does not occur, failing to refinement of grains, and thus a lower limit of the cold rolling reduction ratio is set to 50%.

The present disclosure was designed to obtain a yield strength of 800 Mpa or more, a tensile strength of 1200 MPa or more, and an elongation of 20% or more by obtaining a fine grain structure by cold annealing heat treatment at a relatively low temperature of 800 to 1000 after cold rolling.

The cold annealing may be performed at a temperature of 800 to 1,000° C. In addition, the cold annealing according to an embodiment of the present disclosure may be performed at a temperature of 800 to 1,000° C. for 10 seconds to 10 minutes.

In general, grains tend to become coarser as the annealing process is performed at a higher temperature. Since the cold annealing process according to an embodiment of the present disclosure is performed at a temperature of 800 to 1,000° C. which is lower than a common annealing temperature of 1,100° C., a homogeneous recrystallized austenite structure having an average grain size of 5 μm or less may be obtained.

Therefore, in the present disclosure, the cold annealing temperature may preferably be controlled below 1,000° C. to inhibit the growth of grains by reverse-transformation of martensite into austenite. However, in the case where the cold annealing process is performed at a too low temperature, reverse-transformed austenite cannot be sufficiently recrystallized, so that the cold annealing temperature is limited to be 800° C. or higher.

As described above, when a final cold-rolled, annealed material is produced via cold rolling and cold annealing by controlling the temperature range of the cold annealing simultaneously controlling the alloy components, fine grains having a diameter of 5 μm or less may be prepared to obtain the yield strength.

Also, strength may be obtained by the cold rolling and annealing processes without performing skin pass rolling, and thus price competitiveness may be obtained.

The austenitic stainless steel with improved strength according to the present disclosure may be used, for example, in general products for formation, e.g., products such as slab, bloom, billet, coil, strip, plate, sheet, bar, rod, wire, shape steel, pipe, or tube.

Hereinafter, the present disclosure will be described in more detail with reference to the following examples.

Slabs respectively including alloy components as shown in Table 1 below were prepared by ingot melting, and heated at 1,200° C. for 2 hours, followed by hot rolling. After the hot-rolled steel sheets were hot-annealed at 1,100° C. for 90 seconds. Then, cold rolling was performed with a reduction ratio of 70%, and the cold-rolled steel sheets were cold-annealed.

Alloy compositions (wt %), and values of Expression (1), Expression (2), and Expression (3) of respective steel types are shown in Table 1 below.

TABLE 1

| Steel | Component (wt %) | | | | | | | Expression | Expression | Expression |
|---|---|---|---|---|---|---|---|---|---|---|
| type | C | Si | Mn | Ni | Cr | Cu | N | (1) | (2) | (3) |
| 1 | 0.13 | 2 | 7 | 0.13 | 16 | 1 | 0.13 | 25.78 | 2.37 | 5.4 |
| 2 | 0.08 | 1.5 | 6 | 0.2 | 15 | 2 | 0.15 | 15.17 | 2.9 | 1.6 |
| 3 | 0.08 | 1 | 9 | 1 | 16 | 1 | 0.18 | 19.6 | 2.16 | −4.1 |
| 4 | 0.04 | 0 | 7.1 | 4.1 | 17.3 | 0 | 0.21 | 18.40 | 1.77 | −7.7 |
| 5 | 0.08 | 2 | 9.5 | 0.13 | 16 | 0.1 | 0.13 | 8.35 | 2.54 | 7.3 |
| 6 | 0.05 | 2 | 9.5 | 0.13 | 16 | 2 | 0.13 | 0.52 | 2.36 | 7.1 |
| 7 | 0.08 | 2 | 6 | 0.13 | 16 | 2.5 | 0.13 | 10.53 | 2.34 | 8.7 |

TABLE 1-continued

| Steel type | Component (wt %) C | Si | Mn | Ni | Cr | Cu | N | Expression (1) | Expression (2) | Expression (3) |
|---|---|---|---|---|---|---|---|---|---|---|
| 8 | 0.08 | 2 | 6.5 | 0.13 | 14.5 | 1 | 0.10 | 9.04 | 3.04 | 7.4 |
| 9 | 0.12 | 0.6 | 0.8 | 6.8 | 17.1 | 0 | 0.05 | 38.77 | 1.72 | 1.2 |
| 10 | 0.08 | 1 | 6 | 0.13 | 16 | 2.5 | 0.13 | 14.03 | 2.16 | 3.5 |
| 11 | 0.08 | 2 | 5 | 0.2 | 15 | 2 | 0.14 | 12.44 | 3.27 | 6.3 |
| 12 | 0.055 | 0.4 | 1.1 | 8.1 | 18.2 | 0.1 | 0.04 | 19.39 | 1.82 | 6.1 |

After the cold-rolled steel materials including the above composition was cold-annealed at different temperatures in the range of 800 to 1,100° C. for 10 seconds, elongation, yield strength, and tensile strength of each of the cold-annealed materials were measured. Specifically, a tensile test was carried out at room temperature according to the ASTM standard method, and yield strength (MPa), tensile strength (MPa), and elongation (%) measured accordingly are shown in Table 2 below.

Meanwhile, edge cracks and grain refinement during the hot rolling are shown in Table 2 blow.

In the case of the examples in which recrystallization was completed, average grain size was able to be measured. In the case of the comparative examples in which recrystallization could not be started or was incompletely performed by applying low-temperature annealing, grain boundaries could not be defined due to remaining martensite or ferrite, and thus results of whether or not to grains were refined were expressed as 'grain refinement'.

TABLE 2

| | Steel type | Edge crack | Annealing temperature (° C.) | Yield strength (MPa) | Tensile strength (MPa) | Elongation (%) | Grain refinement |
|---|---|---|---|---|---|---|---|
| Example 1 | 1 | X | 850 | 899 | 1265 | 24.6 | O |
| Example 2 | | | 900 | 829.1 | 1287.2 | 29.1 | O |
| Example 3 | 2 | X | 800 | 838.3 | 1338.8 | 20.0 | O |
| Example 4 | | | 850 | 814.2 | 1339.7 | 24.8 | O |
| Comparative Example 1 | 9 | X | 800 | 620.7 | 1097.1 | 21.7 | X |
| Comparative Example 2 | | | 850 | 569.3 | 1078.4 | 22.8 | X |
| Comparative Example 3 | 12 | X | 800 | 594.9 | 876.4 | 35.2 | X |
| Comparative Example 4 | | | 850 | 593.5 | 890 | 36.8 | X |
| Comparative Example 5 | 5 | O | 800 | 700.1 | 1295.8 | 33.0 | O |
| Comparative Example 6 | | | 850 | 604.5 | 1311.6 | 37.9 | O |
| Comparative Example 7 | 6 | O | 800 | 850.6 | 992.9 | 38.8 | O |
| Comparative Example 8 | | | 850 | 769.2 | 951.2 | 41.3 | O |
| Comparative Example 9 | 7 | O | 800 | 908.9 | 1134.4 | 20.5 | O |
| Comparative Example 10 | | | 850 | 887.8 | 1176.2 | 24.3 | O |
| Comparative Example 11 | | | 900 | 750.2 | 1142.8 | 29.2 | O |
| Comparative Example 12 | 10 | X | 800 | 689.4 | 1258.8 | 18.1 | X |
| Comparative Example 13 | | | 850 | 628.6 | 1298.3 | 18.8 | X |
| Comparative Example 14 | 3 | O | 800 | 768 | 1032.2 | 41.0 | O |
| Comparative Example 15 | | | 850 | 729.2 | 1023.5 | 43.2 | O |
| Comparative Example 16 | | | 900 | 692.6 | 1004.6 | 46.3 | X |
| Comparative Example 17 | 11 | X | 800 | 890.3 | 1194.9 | 12.0 | O |
| Comparative Example 18 | | | 850 | 695.4 | 1311.4 | 15.7 | X |
| Comparative Example 19 | | | 900 | 702.5 | 1357.9 | 21.3 | X |
| Comparative Example 20 | 8 | O | 800 | 843.8 | 1299 | 18.47 | O |
| Comparative Example 21 | | | 850 | 811.3 | 1363.9 | 23.1 | O |

TABLE 2-continued

| | Steel type | Edge crack | Annealing temperature (° C.) | Yield strength (MPa) | Tensile strength (MPa) | Elongation (%) | Grain refinement |
|---|---|---|---|---|---|---|---|
| Comparative Example 22 | | | 900 | 581.6 | 1441 | 23.53 | X |
| Comparative Example 23 | 4 | O | 800 | 731.6 | 953 | 43.4 | X |
| Comparative Example 24 | | | 850 | 686.7 | 931.2 | 43.3 | X |
| Comparative Example 25 | | | 900 | 663.8 | 919.4 | 45.3 | X |

Referring Table 2, in the case of Examples 1 to 4 satisfying the alloy compositions, and the ranges of the values of Expressions (1), (2), and (3) according to the present disclosure, it was confirmed that not only a yield strength of 800 MPa or more and a tensile strength of 1200 MPa or more, but also a high elongation of 20% or more were able to be obtained. In addition, price competitiveness may be obtained due to relatively low Ni contents without having edge cracks after hot rolling, thereby increasing yields of the manufacturing process.

In Comparative Examples 5 to 11, Comparative Examples 14 to 16, and Comparative Examples 20 to 25 representing cases using steel types 3 to 8 not satisfying the range of Expression (3), occurrence of edge cracks was confirmed after hot rolling. Once edge cracks occur, an actual yield decreases failing to obtain price competitiveness.

In Comparative Examples 1 to 4, Comparative Examples 12 to 13,

Comparative Example 16, and Comparative Examples 22 to 25 representing cases using steel types 3, 4, 9, 10, and 12 having values of Expression (2) less than 2.3, stability of austenite increases so that fine grains having an average grain diameter of 5 μm or less could not be obtained. Therefore, a target yield strength of 800 MPa or more could not be obtained.

In addition, in Comparative Examples 17 to 19 representing cases using steel type 11 having values of Expression (2) greater than 3.0, the ferrite phase fraction increases to lower the elongation, so that processibility could not be obtained.

Also, in Comparative Examples 1 and 2 representing cases using steel type 9 having values of Expression (1) greater than 30, sufficient phase transformation could not be performed by cold rolling, and thus fine grains could not be formed due to insufficient recrystallization starting sites. Thus, low yield strengths of 620.7 MPa and 569.3 MPa were obtained, respectively.

In addition, the value of Expression (1) of steel type 9 was 38.77 that exceeds the upper limit (30) provided in the present disclosure, and a tensile strength of 1,200 MPa or more could not be obtained because strain-induced martensite was not formed. Therefore, it is difficult to apply steel type 9 to a material that requires high strength.

In Comparative Examples 12 to 13 and Comparative Examples 17 to 19 representing cases using steel types 10 and 11 having values of Expression (1) less than 15, strain-induced martensite is rapidly formed leading to rapid hardening by an external stress. Therefore, a low elongation was obtained failing to obtain processability.

Steel types 1 and 2, which satisfy the alloy composition and the ranges of the values of Expression (1), Expression (2), and Expression (3) of the present disclosure were cold-rolled and cold-annealed with different cold rolling reduction ratios and annealing temperatures, and then yield strength, tensile strength, and elongation thereof were measured and shown in Table 3 below.

TABLE 3

| | Steel type | Cold rolling reduction ratio (%) | Annealing temperature (° C.) | Yield strength (MPa) | Tensile strength (MPa) | Elongation (%) |
|---|---|---|---|---|---|---|
| Example 5 | 1 | 70 | 850 | 899 | 1265 | 24.6 |
| Example 6 | 2 | 70 | 850 | 814 | 1339 | 24.8 |
| Comparative Example 26 | 1 | 70 | 1100 | 677 | 1449 | 39.3 |
| Comparative Example 27 | 2 | 70 | 1100 | 477 | 1276 | 36.1 |
| Comparative Example 28 | 1 | 33 | 850 | 657 | 1279 | 33.3 |

As the cold annealing temperature decreases, the yield strength increases and the tensile strength and the elongation decrease.

Referring to Tables 2 and 3, it was confirmed that a yield strength of 800 Mpa or more, a tensile strength of 1,200 Mpa or more, and an elongation of 20% or more were obtained at a cold annealing temperature of 800 to 1,000° C.

In the case of Comparative Examples 26 and 27 where the cold annealing temperature was 1,100° C., the tensile strength was higher than 1,200 MPa but the yield strength was lower than 800 MPa, and thus desired mechanical properties could not be obtained.

In the case of Comparative Example 28 where the cold rolling reduction ratio was 33%, the tensile strength was higher than 1,200 MPa but the yield strength was lower than 800 MPa, and thus desired mechanical properties could not be obtained. It is considered because phase transformation by cold rolling was not completed and martensite acting as recrystallization sites during annealing was not sufficiently formed when the cold rolling reduction ratio is 50% or less. In addition, it is considered because the yield strength was not obtained due to the coarse austenite phase remaining due to the low cold rolling reduction ratio.

According to the embodiments disclosed herein, austenitic stainless steel having a yield strength of 800 MPa or more, a tensile strength of 1,200 MPa or more, and an elongation of 20% or more may be produced by controlling the alloy composition and the cold annealing temperature within the range of 800 to 1,000° C.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The austenitic stainless steel according to the present disclosure may have improved strength together with excellent elongation and productivity, and thus application to structural members such as vehicles may be possible.

The invention claimed is:

1. An austenitic stainless steel comprising:

in percent (%) by weight, 0.06 to 0.15% of carbon (C), 0.3% or less (excluding 0) of nitrogen (N), more than 1.0% and equal to or less than 2.0% of silicon (Si), 5.0 to 7.0% of manganese (Mn), 15.0 to 16.0% of chromium (Cr), 0.3% or less (excluding 0) of nickel (Ni), 2.5% or less (excluding 0) of copper (Cu), and the remainder of iron (Fe) and inevitable impurities, wherein:

the austenitic stainless steel has a tensile strength is 1200 MPa or more, a yield strength of 800 MPa or more, and an average grain size of 5 μm or less, and the austenitic stainless steel satisfying Expressions (1), (2), and (3) below:

$$15 \leq 0.2Mn+337C+1.2Cu-1.7Cr+3.3Ni+78N-3.5Si+3.0 \leq 30 \quad \text{Expression (1)}$$

$$2.3 \leq [Cr+1.5Si]/[Ni+0.31Mn+22C+1Cu+14.2N] \leq 3.0 \quad \text{Expression (2)}$$

$$1.0 \leq ((Cr+1.5Si+18)/(Ni+0.52Cu+30(C+N)+0.5Mn+36)+0.262)*161-161 \leq 7.0 \quad \text{Expression (3)}$$

wherein C, N, Si, Mn, Cr, Ni, and Cu refer to contents of the elements, respectively.

2. The austenitic stainless steel of claim 1, wherein an elongation is equal to or more than 20% and equal to or less than 30%.

3. The austenitic stainless steel of claim 1, wherein an elongation is equal to or more than 25% and equal to or less than 30%.

* * * * *